US009591722B2

(12) United States Patent
Adenau

(10) Patent No.: US 9,591,722 B2
(45) Date of Patent: Mar. 7, 2017

(54) LIGHTING SYSTEM

(71) Applicant: MA Lighting Technology GmbH, Waldbüttelbrunn (DE)

(72) Inventor: Michael Adenau, Würzburg (DE)

(73) Assignee: MA LIGHTING TECHNOLOGY GMBH, Waldbüttelbrunn (DE)

( * ) Notice: Subject to any disclaimer, the term of this patent is extended or adjusted under 35 U.S.C. 154(b) by 1025 days.

(21) Appl. No.: 13/845,255

(22) Filed: Mar. 18, 2013

(65) Prior Publication Data

US 2014/0265924 A1 Sep. 18, 2014

(51) Int. Cl.
*H05B 37/02* (2006.01)
*H05B 33/08* (2006.01)

(52) U.S. Cl.
CPC ..... *H05B 37/0245* (2013.01); *H05B 33/086* (2013.01); *H05B 37/02* (2013.01); *H05B 37/029* (2013.01); *H05B 37/0254* (2013.01)

(58) Field of Classification Search
CPC H05B 37/02; H05B 37/0245; H05B 37/0254; H05B 37/029; H05B 33/086
USPC ..... 315/297, 307, 308, 312
See application file for complete search history.

(56) References Cited

U.S. PATENT DOCUMENTS 4,392,187 A * 7/1983 Bornhorst ..... F21S 2/00 362/233
6,331,756 B1 * 12/2001 Belliveau ..... H05B 37/029 315/316
8,319,452 B1 * 11/2012 Hamel ..... H05B 37/029 315/291
2005/0248299 A1 * 11/2005 Chemel ..... H05B 37/029 315/312
2009/0085500 A1 * 4/2009 Zampini, II ..... H05B 33/0857 315/297

* cited by examiner

*Primary Examiner* — Tung X Le
(74) *Attorney, Agent, or Firm* — Quarles & Brady LLP

(57) ABSTRACT

A lighting system includes at least one lighting control console for controlling lighting devices, at least two redundant data networks, at least one conversion module, and at least one lighting device actuated by the DMX control data of the conversion module. The conversion module includes at least two redundant conversion devices. At least one switch-over device is interconnected between the two conversion devices on the one side and at least one lighting device actuated by the conversion devices on the other side. The two conversion devices on the one side and the switch-over device on the other side are connected to one another via at least one monitoring data line over which monitoring signals are transmitted. The switch-over device can be switched depending on the monitoring signals.

10 Claims, 1 Drawing Sheet

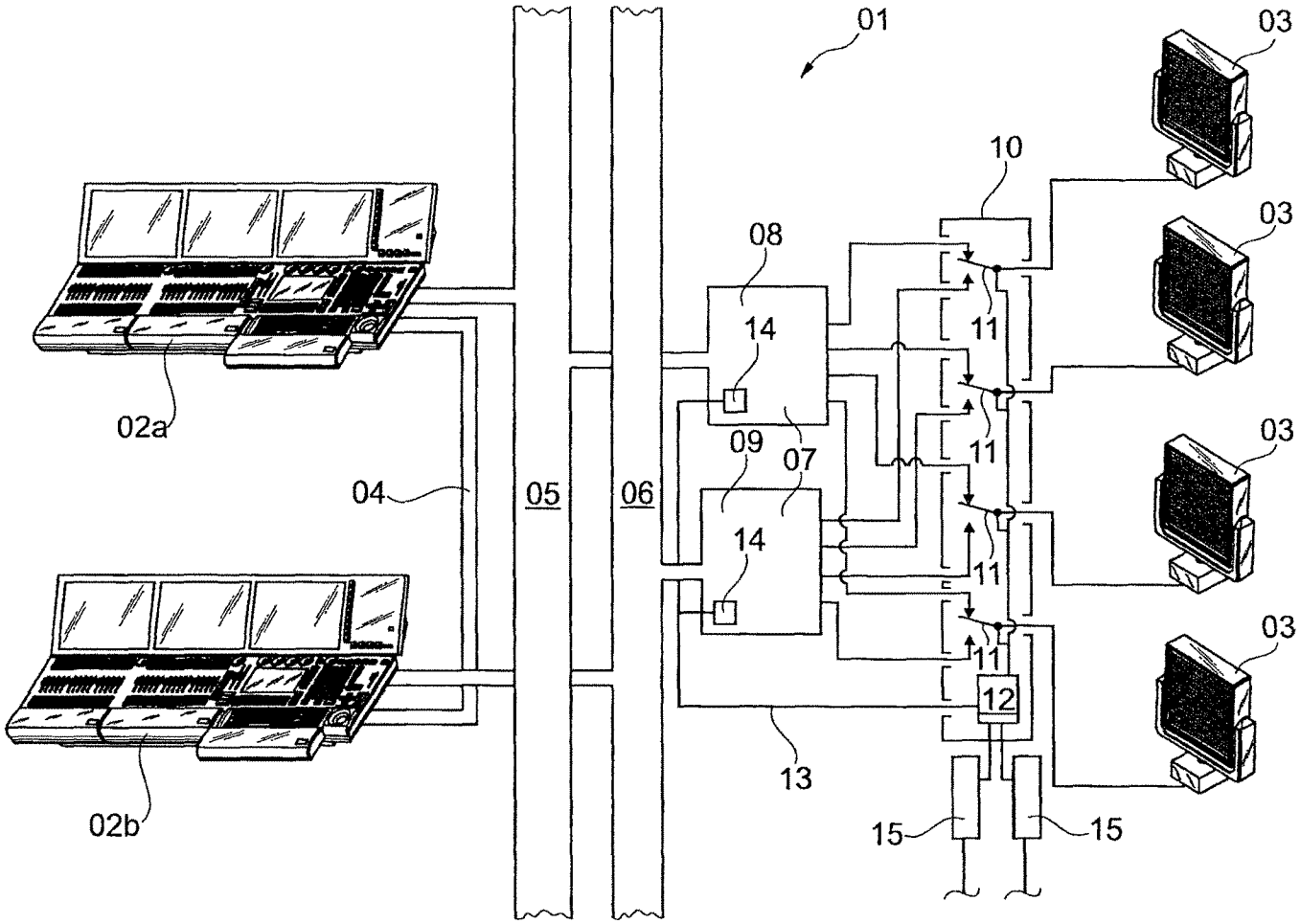
03
03
03
03
10
11
11
11
11
12
15
15
01
08
14
07
09
14
13
06
05
04
02a
02b

LIGHTING SYSTEM

CROSS REFERENCE TO RELATED APPLICATION

Not Applicable.

STATEMENT REGARDING FEDERALLY SPONSORED RESEARCH OR DEVELOPMENT

Not applicable.

FIELD OF THE INVENTION

The invention relates to a lighting system as used in particular for illuminating stages and concert halls.

BACKGROUND OF THE INVENTION

In particular, but by no means exclusively, generic lighting systems are used for professionally lighting stages and concert halls. Here, the lighting system is controlled by at least one lighting control console, in which the control data for actuating the multiple lighting devices, which can be spotlights, LED panels or other types of stage lighting devices, are generated, managed, stored and output to the lighting devices. To this effect, the lighting control console is based on digital data technology and thus comprises a digital processor and at least one digital memory. The control programs for controlling the lighting system can be highly complex data processing programs with which several thousand lighting devices have to be actuated at the same time.

In addition, the generic lighting system comprises at least two redundant data networks on which the digital control data of the lighting control console can be transmitted independently of each other. Here, installing at least two redundant data networks serves to improve the reliability, availability and security of the lighting system. That is because, in case of an outage of one data network, its task can be taken over by the second data network. This redundancy is in particular of vital importance with large live stage shows since an outage of the data network would otherwise make it impossible to carry out the event at all.

The lighting devices used in stage technology, such as spotlights and LED panels, are actuated by means of DMX control data throughout the industry sector. DMX is a control protocol which is implemented in stage technology and event engineering for controlling dimmers, spotlights, moving heads, effect devices and other types of lighting devices. Here, the abbreviation DMX stands for Digital Multiplex. DMX is based on the control protocol RS-485 and uses a symmetric transmission process. By means of the symmetric transmission, DMX provides a high resistance to failures since external failures affect both data lines in a uniform way and are not interpreted as a level in itself, but only as a level difference on the receiver. Due to the actuation of the lighting devices which are common in stage technology by means of the DMX control data protocol, with the generic lighting systems, a conversion module is required in which the digital control data generated by the lighting control console and transmitted in the data network are converted into DMX control data. Subsequently, one or more lighting devices are in turn connected to said conversion modules, such that the converted digital control commands can be transmitted to the individual lighting devices after having been converted into the DMX control data protocol.

When using the generic lighting systems, one problem is the reliability, the availability and the security of the conversion modules used in the lighting system. Since the conversion modules ultimately are the terminal station for the redundantly designed data networks, an outage of a conversion module cannot be compensated by the redundancy devices of the known lighting systems. With the known lighting systems, an outage of a conversion module rather means that all lighting devices connected to the conversion module cannot be actuated anymore and thus fail.

SUMMARY OF THE INVENTION

Therefore, the object of the present invention is to provide a lighting system with which the security, the availability and the reliability of the lighting system can be further improved. In addition, it is the object of the present invention to provide a conversion module and a switch-over module for setting up the lighting system according to the invention.

These objects are attained by a lighting system incorporating the invention including a conversion module and a switch-over module according to the teaching of the independent main claims. Advantageous embodiments of the invention are the subject matter of the dependent claims.

The novel lighting system is based on the fundamental idea that the conversion modules also have a redundancy with respect to a possible failure. For realizing this redundancy, in the conversion module of the lighting system according to the invention, at least two redundant conversion devices are provided. Here, the first conversion device is connected to the first data network and the second conversion device is connected to the second data network. As a result, via separate data networks, both conversion devices in the conversion module thus receive the same digital control data in each case for actuating the lighting devices, and convert said data into DMX control data separately from each other.

On their part, via their outputs, the two conversion devices are in turn connected to a switch-over device which is interconnected between the conversion devices on the one side and the lighting devices to be actuated on the other side. Depending on the switching state of the switch-over device, either the output of the first conversion device or the output of the second conversion device is switched over to the connected lighting devices, such that only one of the two conversion devices transmits the DMX control data to the connected lighting devices in each case. In this way, it is achieved that, depending on the switching state of the switch-over device, either the DMX control data of the first conversion device or the DMX control data of the second conversion device are transmitted to the lighting device. For realizing the desired redundancy of the conversion module, it is also envisaged that the two conversion devices on the one side and the switch-over device on the other side are connected to one another via a monitoring data line. Via said monitoring data line, the two conversion devices transmit monitoring signals to the switch-over device. Here, the monitoring signals characterize the operational availability of the respective conversion device, such that, by means of a corresponding evaluation of the monitoring signals in the switch-over device, it can be determined whether the respective conversion device is ready for operation.

The switch-over device, on its part, can subsequently be switched, depending on the monitoring signals. During normal operation of the lighting system according to the invention, both conversion devices are ready for operation and transmit corresponding monitoring signals to the switch-over device. In this case, one of the two conversion devices, which may also have a defined preference, is subsequently switched over to the signal lines to the lighting devices. Under these conditions, the other conversion device runs idle and does not transmit its DMX control data. If one of the two conversion devices now fails, this is registered by means of a change in the monitoring signal sequence in the switch-over device. If, for instance, one of the two conversion devices does not provide monitoring signals anymore because, for instance, the power supply for said conversion device has failed or the conversion device itself has been destroyed, the switch-over device is automatically switched in such a way that the DMX control data of the other conversion device are transmitted to the lighting devices. In this way, it is ensured that, if one of the two conversion devices fails, the lighting devices connected thereto do not fail, but rather a switch-over to the second conversion device is performed and the light show can be continued without any interruptions.

If the two redundant conversion devices each contain multiple outputs, in which DMX control data for a lighting device are output, respectively, for each of said outputs, a switch-over device has to be provided with which, depending on the monitoring signals, the corresponding lighting device is either switched over to the first conversion device or to the second conversion device. For reducing the installation complexity, it is therefore particularly advantageous if the different switch-over devices are joined in a common switch-over module which is advantageously also placed in a separate housing. Here, the number of the switch-over devices in the switch-over module should correspond to the number of the respective DMX outputs with the different conversion devices.

If a switch-over module with multiple switch-over devices is used in the lighting system according to the invention, the installation complexity within the switch-over module can be reduced by using an electronic monitoring data interface. In this case, the monitoring data interface is connected to the monitoring data line and receives the monitoring signals of the two assigned conversion devices. In the monitoring data interface, the monitoring data are evaluated and the multiple switch-over devices in the switch-over module are switched together by the monitoring data interface depending on the monitoring signal. This means that the monitoring data interface combines the evaluation of the monitoring signals for all switch-over devices of one switch-over module and subsequently switches the switch-over devices together, in each case depending on said evaluation.

In order to further improve the security, reliability and availability, it is particularly advantageous if the switch-over module comprises two redundant energy supplies operating independently of each other, in particular two redundant power adapters. In this way, it is ensured that, if one energy supply in the switch-over module fails, the switch-over module itself is not interrupted, but rather the energy supply is taken over by the second energy supply system.

Furthermore, it is particularly advantageous if, via the monitoring data line, data between the conversion devices on the one side and the switch-over device or the switch-over module on the other side can be bidirectionally transmitted. In this way, it becomes possible that not only the monitoring signals can be transmitted from the conversion devices toward the switch-over device or toward the switch-over module, but, due to the bidirectional data transmission, it becomes possible to also transmit data from the switch-over module or the switch-over devices toward the conversion devices.

In order to avoid random switching states of the switch-over device or the switch-over module, it is advantageous if the switch-over devices have a normal position which is automatically taken up when no monitoring data are received on the monitoring data line. By means of this preference, it is established which of the two conversion devices is joined with the connected lighting devices and which of the two conversion devices runs idle. Furthermore, it is particularly advantageous if the monitoring signals for describing the operational availability of the two conversion devices can also be transmitted to the lighting control console via the connected data networks. In this way, the monitoring signal sequence in the lighting control console can be evaluated and, in case one of the conversion devices fails, a corresponding reaction is made possible. Thus, it is in particular precluded that a conversion device unnoticedly fails.

With regard to improving the security, reliability and availability, it is additionally particularly advantageous if at least two lighting control consoles operating redundantly are provided in the lighting system. Thereby, it is achieved that, if one lighting control console fails, the other lighting control console suitably takes over control of the lighting system.

The switch-over module according to the invention is characterized by an electronic monitoring data interface which can be connected to multiple conversion devices via a monitoring data line. In the monitoring data interface, the monitoring signals of the connected conversion devices can subsequently be evaluated and the switch-over devices provided in the switch-over module can be switched together depending on the evaluation result.

The conversion module according to the invention is characterized by at least two redundant conversion devices which can be connected to a data network, respectively. In the conversion module, at least one electronic monitoring data interface is provided which transmits monitoring signals for describing the operational availability of the conversion devices provided in the conversion module to the connected switch-over devices or to the connected switch-over module via the monitoring data line.

BRIEF DESCRIPTION OF THE DRAWINGS

One embodiment of the invention is schematically illustrated in the drawing and is exemplified in the following.

In the drawing:

FIG. 1 shows a lighting system according to the invention in a schematic view.

DETAILED DESCRIPTION OF THE EXAMPLE EMBODIMENTS

In FIG. 1, a lighting system 01 comprising two lighting control consoles 02 for actuating a plurality of lighting devices 03 is schematically illustrated. Here, the two lighting control consoles 02 operate redundantly and are connected to each other via a data line 04, in order to synchronize the data processing in the two lighting control consoles 02.

The control data generated in the lighting control console 02*a* are transmitted via a first digital data network 05, for instance an internet data network. The digital control data generated in the lighting control console 02*b*, however, are transmitted via a second digital data network 06. The two data networks 05 and 06 thus form a redundant data structure, such that, in case of an outage of one of the two data networks, its activity can be taken over by the other data network. The digital control data generated by the lighting control consoles 02 and transmitted in the data networks 05 and 06 cannot be processed directly in the lighting devices 03 since the lighting devices 03 can only process DMX control data. For this reason, a conversion module 07 is interconnected between the data networks 05 and 06, respectively, on the one side and the lighting devices 03 on the other side. Here, said conversion module 07 comprises two conversion devices 08 and 09, wherein the digital control data from the data network 05 are converted into DMX control data in the conversion device 08 and the digital control data from the data network 06 are converted into DMX control data in the conversion device 06. The two conversion devices 08 and 09 can be installed in a common housing or rack for forming the conversion module 07. In the illustrated variant, the two conversion devices 08 and 09 each have a separate housing, wherein the conversion module 07 is formed without a physical connection between said two housings.

Here, each of the two conversion devices 08 and 09 has four outputs and can thus transmit DMX control data to four lighting devices 03. Between the four lighting devices 03 on the one side and the two conversion devices 08 and 09 in the conversion module 07 on the other side, a switch-over module 10 is interconnected in which the four switch-over devices 11 are provided. Each output of the four switch-over devices 11 is connected to one of the four lighting devices 03. The outputs of the conversion devices 08 and 09, which are assigned to one of the four lighting devices 03, respectively, are connected to the two inputs—in each case—of each switch-over device 11. During normal operation of the lighting system 01, at both inputs, a switch-over device 11 receives the same DMX control data which are envisaged for the lighting devices connected to the output in each case. During normal operation of the lighting system 01, the switching state of the switch-over device 11 is thus irrelevant in principle. In the switch-over module 10, a monitoring data interface 12 is provided which is connected to two monitoring data interfaces 14 in the two conversion devices 08 and 09 via a monitoring data line 13. In the monitoring data interfaces 14, monitoring data are generated which characterize the operational availability of the respective conversion device 08 and 09, respectively. Said monitoring data are subsequently transmitted to the monitoring data interface 12 in the switch-over module 10 via the monitoring data line 13.

If the operational availability of one of the two conversion devices 08 and 09 is limited, the monitoring signal sequence is correspondingly changed by the monitoring data interfaces 14. If, for instance, one of the two conversion devices 08 or 09 fails, this is communicated to the monitoring data interface 12 in the switch-over module by a change in the monitoring data signal sequence. By evaluating the monitoring data, in the monitoring data interface 12 of the switch-over module 10, the operational availability of the two conversion devices 08 and 09 can thus be assessed. Depending on the operational availability, the switch-over devices 11 are subsequently either switched over to the first input or to the second input. In FIG. 1, for instance, the switching state in the normal state of the switch-over devices 11 is illustrated, with which the switch-over devices 11 are respectively switched to the output of the conversion device 08. If the conversion device 08 now fails, this is communicated to the monitoring data interface 12 in the switch-over module 10 by the monitoring data interface 14 of the switch-over device 11, and subsequently, the switch-over devices 11 are automatically switched over to the inputs which are connected to the conversion device 09. In this way, the lighting devices 03 still receive the required DMX control data although the conversion device 08 has failed.

Here, the data transmission in the monitoring data line 13 should be bidirectional if possible, such that data can also be transmitted from the switch-over module 10 toward the conversion module 07. Additionally, the monitoring data for characterizing the operational availability of the conversion devices 08 and 09 should also be transmitted to the two lighting control consoles 02 via the two data networks 05 and 06, such that, if one of the two conversion devices fails, a corresponding reaction can be triggered.

For improving the security and availability of the switch-over module 10, it is additionally envisaged that the switch-over module 10 comprises two separate power adapters 15 which redundantly provide the switch-over module 10 with the required supply energy.

The invention claimed is:

1. A lighting system comprising:

- at least one lighting control console for controlling lighting devices, the lighting control console including at least one digital processor and at least one digital memory which are suitable for generating, managing and storing digital control data for actuating lighting devices;
- at least two redundant data networks on which the digital control data of the lighting control console is transmitted independently of each other;
- a first conversion module connected to a first data network of the at least two redundant data networks, the first conversion module converting digital control data transmitted in the first data network into DMX control data;

a second conversion module connected to a second data network of the at least two redundant data networks, the second conversion module converting digital control data transmitted in the second data network into DMX control data;

- at least one lighting device actuated by DMX control data of the conversion module and the second conversion module;

-at least one switch-over device interconnected between the first conversion module and the second conversion module on one side, and the at least one lighting device on an other side, wherein depending on a switching state of the at least one switch-over device, one of the DMX control data of the first conversion device and the DMX control data of the second conversion device is transmitted to the at least one lighting device; and

- at least one monitoring data line connecting the first conversion module and the second conversion module on the one side and the at least one switch-over device on the other side, wherein monitoring signals describing operational availability of the first conversion module and the second conversion module are transmitted to the at least one switch-over device over the at least one monitoring data line, wherein the at least one switch-over device is switched depending on the monitoring signals.

2. The lighting system according to claim 1, in which the at least one switch-over device includes multiple switch-over devices forming a common switch-over module.

3. The lighting system according to claim 2, in which the switch-over module includes an electronic monitoring data interface receiving the monitoring signals describing the operational availability of the first conversion module and the second conversion module via at least the monitoring data line, wherein the multiple switch-over devices in the switch-over module are switched together by the monitoring data interface depending on a monitoring signal sequence.

4. The lighting system according to claim 2, in which the switch-over module includes two redundant energy supplies operating independently of each other.

5. The lighting system according to claim 2, in which via the monitoring data line, data between the first conversion module and the second conversion module on the one side and one of the at least one switch-over device and the switch-over module on the other side is bidirectionally transmitted.

6. The lighting system according to claim 1, in which the at least one switch-over device has a normal position which is automatically taken up when no monitoring signals are transmitted on the monitoring data line.

7. The lighting system according to claim 1, in which the monitoring signals describing the operational availability of the first conversion module and the second conversion module are also transmitted to the at least one lighting control console via the data networks.

8. The lighting system according to claim 1, in which the lighting system includes at least two lighting control consoles operating redundantly.

9. A switch-over module comprising:

multiple switch-over devices, wherein at least two conversion devices are connected to the switch-over module, and wherein, depending on a switching state of the switch-over devices, one of DMX control data of a first conversion device of the at least two conversion devices and DMX control data of a second conversion device of the at least two conversion devices are transmitted to at least one connected lighting device; and an electronic monitoring data interface receiving monitoring signals describing operational availability of the at least two conversion devices via at least one monitoring data line.

10. The switch-over module according to claim 9, in which the multiple switch-over devices are connected together to the monitoring data interface and are synchronously switched by the monitoring data interface, depending on a monitoring signal sequence.

* * * * *